United States Patent [19]

Maier et al.

[11] 4,047,134

[45] Sept. 6, 1977

[54] CIRCUIT BREAKER

[75] Inventors: Alfred E. Maier, Beaver Falls; William I. Stephenson, Jr., Beaver, both of Pa.

[73] Assignee: Westinghouse Electric Corporation, Pittsburgh, Pa.

[21] Appl. No.: 579,756

[22] Filed: May 22, 1975

[51] Int. Cl.[2] ..... H01H 73/48

[52] U.S. Cl. ..... 335/23; 335/35; 337/71

[58] Field of Search ..... 335/23, 169, 173, 35, 335/21, 38, 43, 39, 174; 337/71, 72, 73, 77

[56] References Cited

U.S. PATENT DOCUMENTS

| | | | |
|---|---|---|---|
| 2,659,783 | 11/1953 | Casey | 335/23 |
| 2,925,481 | 2/1960 | Casey | 335/23 |
| 3,462,716 | 8/1969 | Yorgin et al. | 335/23 |

*Primary Examiner*—Harold Broome
*Attorney, Agent, or Firm*—Robert E. Converse, Jr.

[57] ABSTRACT

A molded case circuit breaker having thermal and magnetic trip means. A moving contact support structure is disposed about the magnetic trip means so as to cause current flowing through the circuit breaker contacts to pass twice through the magnetic circuit of the magnetic trip means. The moving contact support structure includes resistance material operable upon overcurrent conditions through the contacts to aid in heating the thermal trip means. An operating mechanism includes an operating spring in compression which acts as one leg of a toggle linkage and stores energy to operate the contacts with a snap action.

12 Claims, 26 Drawing Figures

CIRCUIT BREAKER

BACKGROUND OF THE INVENTION

1. Field of the Invention

The invention relates in general to electrical apparatus, and, more particularly, to circuit breakers having thermal and magnetic trip means.

2. Description of the Prior Art

Circuit breakers are widely used in commercial, industrial, and residential applications to provide on-off switching control of electrical apparatus and to provide protection to such apparatus by automatically interrupting the flow of current to the apparatus upon overcurrent conditions. Many circuit breakers provide rapid interruption of short-circuit conditions and delayed interruption of slight overload conditions by employing magnetic and thermal trip mechanisms. Magnetic trip mechanisms use current flow through the separable contacts of the circuit breaker to produce a magnetic field which attracts an armature, thereby releasing a latch and automatically opening the contacts. Thermal mechanisms route the circuit breaker breaker flow through a bimetal member so that an overcurrent flowing through the bimetal member will generate heat and cause the bimetal member to deflect, thereby releasing a latch and automatically opening the circuit breaker. It is desirable to provide thermal and magnetic trip assemblies which are more sensitive to current flow therethrough, thereby providing an increased measure of protection.

While circuit breakers provide convenience and protection in the control of electrical apparatus, their size and cost has made it impractical to include them in many installations. It is desirable to provide a circuit breaker of lower cost and more compact construction to allow the use of such a circuit breaker in a wider variety of applications.

SUMMARY OF THE INVENTION

The invention provides a circuit breaker having an insulating housing, separable contacts comprising a stationary contact and a moving contact, an operating handle to open and close the contacts, releasable means operable upon actuation to automatically open the contacts, thermal trip means operable upon slight overcurrent conditions to actuate the releasable means, magnetic trip means operable upon sudden severe overcurrent conditions to actuate the releasable means, and a moving contact support structure. The moving contact support structure includes a moving contact support arm of resistance material to provide heat to the thermal trip means. The moving contact support structure is disposed about the magnetic trip means so as to cause current flow through the contacts to pass two times through the magnetic circuit of the magnetic trip means. The invention thus provides a circuit breaker having increased sensitivity, thereby providing a higher degree of protection. The circuit breaker is of compact, economical construction to reduce the requirements of cost and space.

BRIEF DESCRIPTION OF THE DRAWINGS

The invention may be more readily understood when considered in view of the following detailed description of exemplary embodiments thereof, taken with the accompanying drawings, in which.

DESCRIPTION OF THE PREFERRED EMBODIMENT

Figure 1:
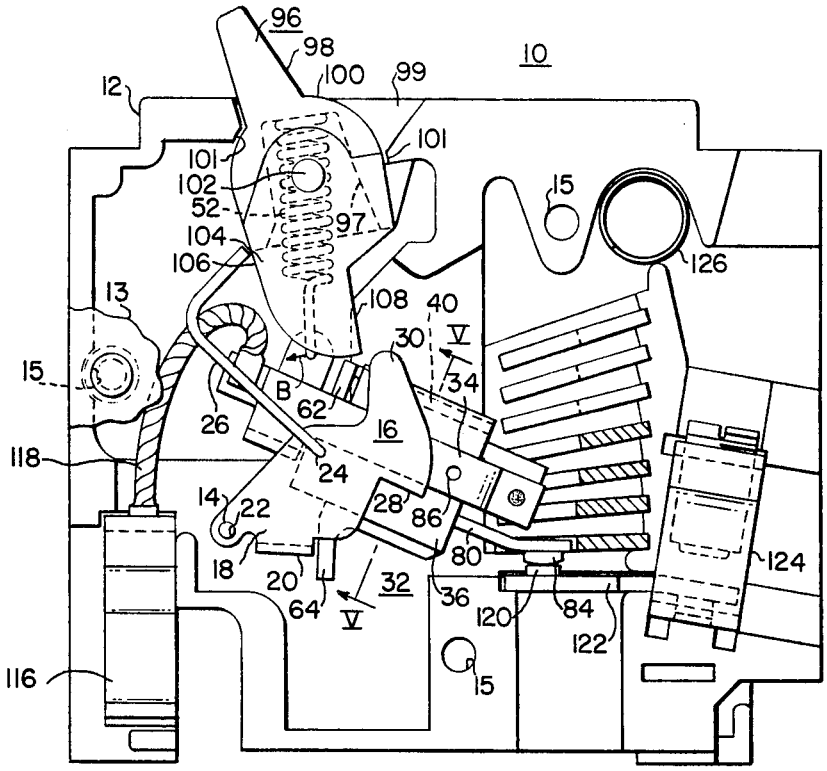
FIG. 1 is a side elevational view of a circuit breaker constructed in accordance with the principles of the invention, with the cover partially cut away and the movable contacts in the closed circuit position.

Throughout the drawings, like reference characters refer to like elements.

Figure 4:
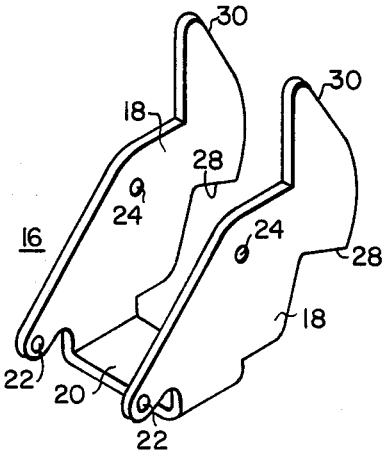
FIG. 4 is a perspective view of the latch lever shown in FIGS. 1 through 3.

Referring now to the drawings, and FIG. 1 in particular, there is shown a side elevational view, with the cover partially cut away, of a circuit breaker 10 constructed in accordance with the principles of the invention. The circuit breaker 10 includes a housing 12 molded from insulating material and having a plurality of ribs and recesses. A cover 13 of insulating material is attached to the insulating housing 12 by screws or rivets (not shown) which pass through the three holes 15. A metal pivot pin 14 is held in a blind hole in the insulating housing 12 and provides a pivot support for the latch lever 16, shown more clearly in FIG. 4. The latch lever 16 is of symmetrical construction and includes two side plates 18 connected by a cross member 20. Extending through each of the side plates 18 is a pivot hole 22 (through which extends the pivot pin 14) and a hole 24 for supporting the reset lever and pivot pin 26. Each side plate 18 also includes a latch surface 28 and an operating ear 30.

A moving contact assembly 32 is pivotally supported between the side plates 18 by the reset lever and pivot pin 26. The moving contact assembly 32 (shown more clearly in FIG. 5) includes a contact support structure 34, a magnetic structure 36, a bimetal element 38, and a magnetic member or armature 40.

Figure 24:
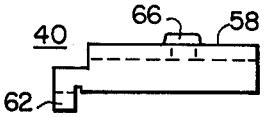
FIG. 24 is a top view of the armature.
Figure 22:
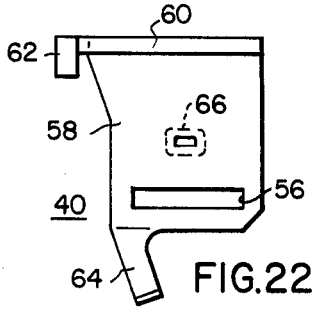
FIG. 22 is a front elevational view of the armature.
Figure 23:
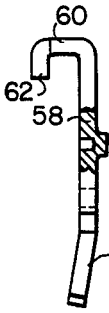
FIG. 23 is a right side elevational view of the armature.
Figure 9:
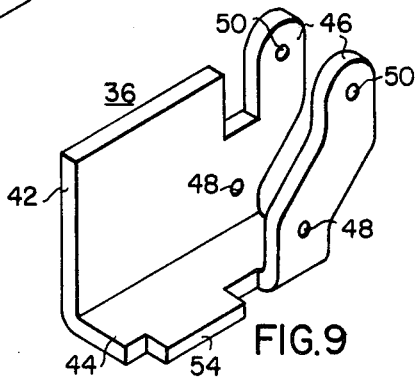
FIG. 9 is a perspective view of the magnet structure shown in FIG. 1.
Figure 18:
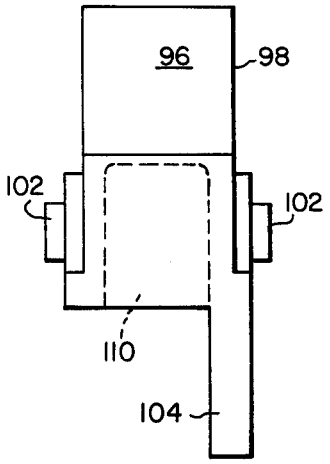
FIG. 18 is a left side elevational view of the operating handle.
Figure 17:
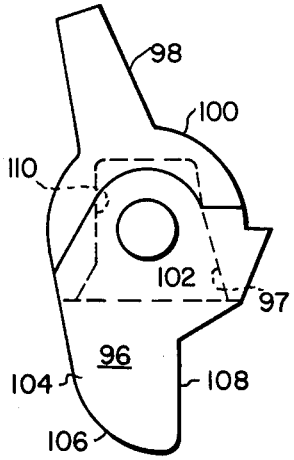
FIG. 17 is a front elevational view of the operating handle shown in FIG. 1.
Figure 19:
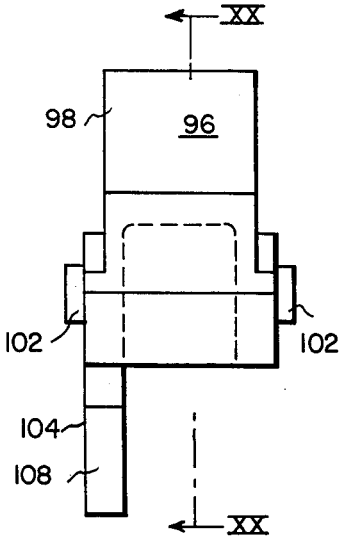
FIG. 19 is a right side elevational view of the operating handle.
Figure 20:
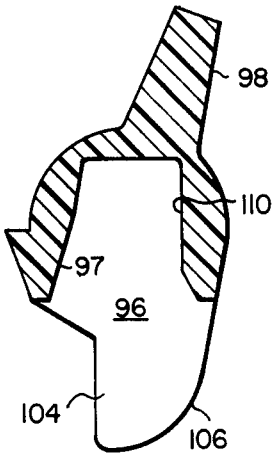
FIG. 20 is a sectional view of the operating handle shown in FIG. 18 taken substantially along the line XX—XX of FIG. 19.
Figure 21:
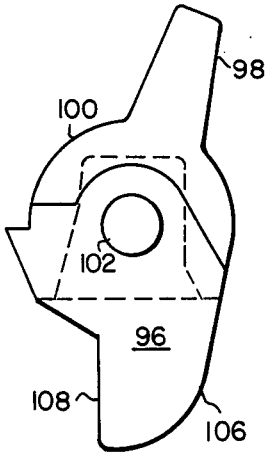
FIG. 21 is a rear elevational view of the operating handle.

Referring to FIG. 9 the magnet structure 36 includes a magnet plate 42, a base portion 44, and two extending legs 46. The legs 46 include two pivot holes 48 through which extend the reset lever and pivot pin 26, and two holes 50 for pivotal attachment of the operating spring 52. The base 44 includes a seating tab 54 which is engaged by a slot 56 in the armature 40. The armature 40, shown more clearly in FIGS. 22–24, includes a face member 58 and a top member 60 formed at right angles to the face member 58. A small holding tab 62 extends downward from the top member 60. A leg 64 extends downward and inward from the face member 58. A latch member or tab 66 is stamped in the face member 58 and extends outward in the direction opposite to the leg 64.

Figure 5:
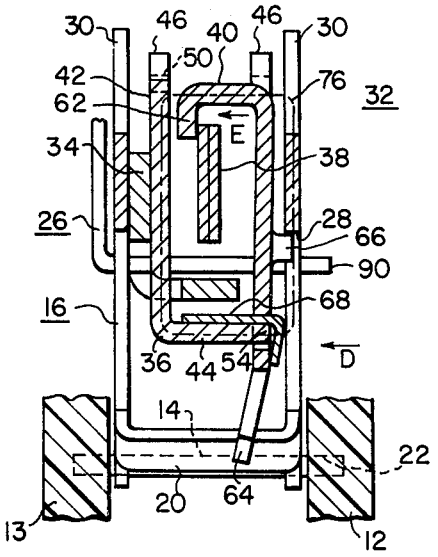
FIG. 5 is a sectional view of the moving contact assembly shown in FIG. 1, taken along the line V—V.
Figure 10:
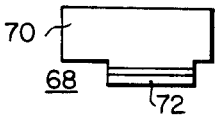
FIG. 10 is a front elevational view of the bias spring shown in FIG. 5.
Figure 11:
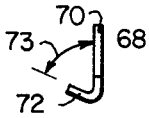
FIG. 11 is a right side elevational view of the bias spring shown in FIG. 5.

A bias spring 68, shown in FIGS. 10 and 11, is bent to form a base element 70 and side element 72 with an acute angle 73 therebetween. The bias spring 68 is seated upon the base 44 of the magnet 36, as is shown in FIG. 5. The spring 68 is stressed so as to reduce the acute angle 73 between the base element 70 and side element 72, thereby producing a force D upon that portion of the armature 40 below the slot 56. This force tends to pivot the armature 40 in a clockwise direction (FIG. 5) about the edge of the base 44 of the magnet 36, thereby forcing the latch tab 66 outward into engagement with the latch surface 28 of the latch lever 16. The armature 40 and the magnetic structure 36 form an open-ended box structure and constitute a magnetic circuit 76 as shown in FIG. 5.

Figure 7:
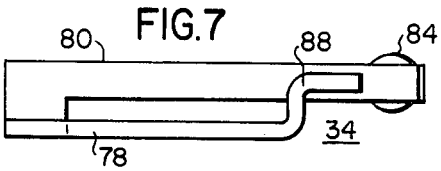
FIG. 7 is a top elevational view of the moving contact support structure shown in FIG. 1.
Figure 8:
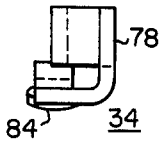
FIG. 8 is a right side elevational view of the moving contact support structure shown in FIG. 1.
Figure 6:
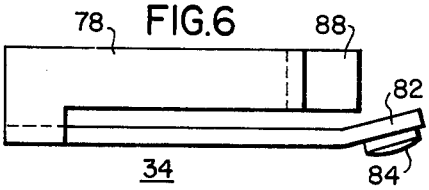
FIG. 6 is a front elevational view of the moving contact support structure shown in FIG. 1.

The contact support structure 34 shown in FIGS. 6 through 8 includes a connecting arm 78 having two offset ends, attached to one of which is a contact arm 80 of resistance material. The free end 82 of the contact arm 80 is bent upward at an angle and has attached thereto a movable contact 84. The connecting arm 78 is spot-welded to the magnetic structure 36 at the point 86 (FIG. 1). The bimetal element 38 extends through the magnetic circuit 76 and is spot welded to the free end 88 of the connecting arm 78.

Figure 13:
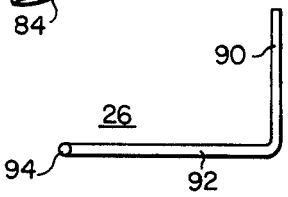
FIG. 13 is a front elevational view of the reset lever and pivot pin shown in FIG. 1.
Figure 12:
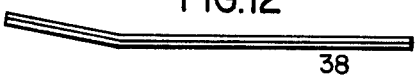
FIG. 12 is a side elevational view of the bimetal member shown in FIG. 5.
Figure 12A:
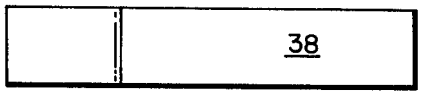
FIG. 12A is a top elevational view of the bimetal member.
Figure 14:
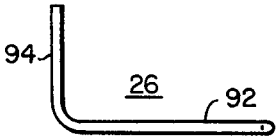
FIG. 14 is a side elevational view of the reset lever and pivot pin.
Figure 15:
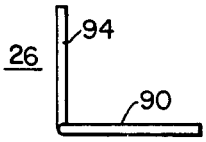
FIG. 15 is a top elevational view of the reset lever and pivot pin.

The reset lever and pivot pin 26 is shown in FIGS. 13 through 15. It includes three mutually perpendicular sections 90, 92, 24. The longer end 90 extends through the holes 24 in the latch lever 16 and the holes 48 in the magnet 36 to provide a pivot point therebetween.

Figure 16:
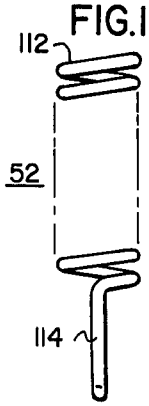
FIG. 16 is a front elevational view of the operating spring shown in FIG. 1.
Figure 16A:
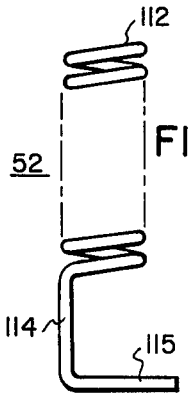
FIG. 16A is a top elevational view of the operating spring shown in FIG. 1.

An operating handle 96 is shown in FIGS. 17 through 21. The handle 96 includes a handle member 98 extending from an arcuate surface 100 centered upon trunnions 102. The trunnions 102 are seated in recesses (not shown) in the insulating housing 12 and cover 9. Extending downward from the handle 96 is an operating member or lever 104 having a curved surface 106 and a straight surface 108. A cavity 110 is molded in the handle 96 to provide an operating member or surface 97 and a seat for the compression operating spring 52. The operating spring 52, shown more clearly in FIGS. 16 and 16A, has one end 112 seated under compression in the cavity 110 of the handle 96. The other end 114 of the spring 52 is bent to provide a pivot pin 115 extending through the holes 50 of the magnet structure 36.

A standard clip-type terminal 116 adapted to engage a stab member is seated in a recess of the insulating housing 12. The terminal 116 is welded to one end of a woven shunt 118, the other end of which is welded to the bimetal element 38. A fixed contact 120 is attached to a conducting element 122 which is engaged by a standard screw-type terminal 124. When the circuit breaker 10 is in a closed position current flows from the screw terminal 124 through the conducting element 122, the fixed contact 120, the moving contact 84, the contact arm 80 (FIG. 6) and connecting arm 78 of the contact support structure 34, the bimetal element 38, and the wovenshunt 118 to the clip terminal 116.

An arc screen 126 is formed from a length of steel spring and is seated in a recess of the insulating housing 12.

The handle member 98 of the handle 96 extends upward through an aperture 99 in the insulating housing 12. The arcuate member 100 is in sliding contact with the surfaces 101 of theinsulating housing 12 to close the aperture 99 in all positions of the operating handle 96.

Figure 2:
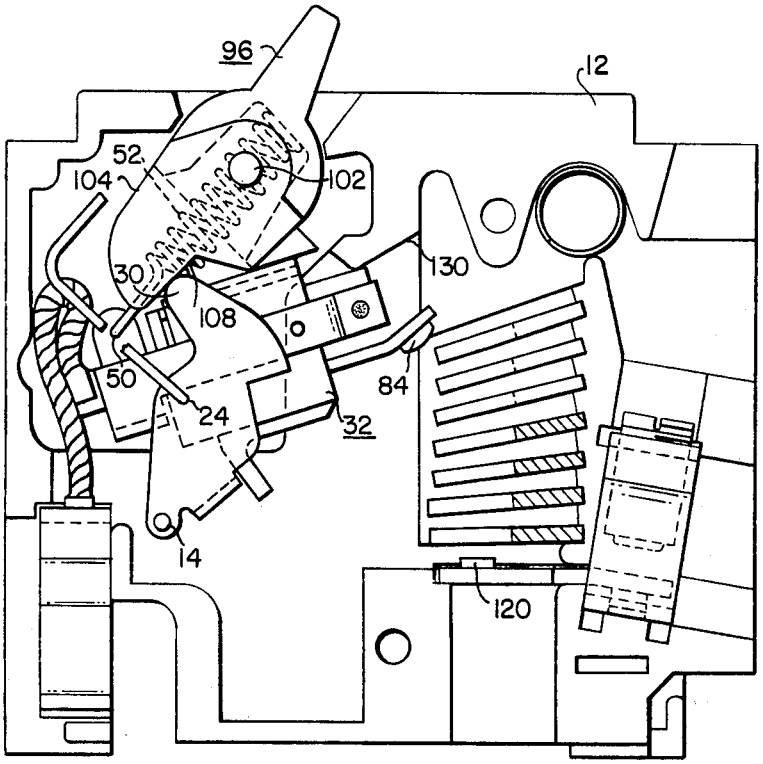
FIG. 2 is a view similar to FIG. 1 with the circuit breaker contacts shown in the open circuit position.

To actuate the circuit breaker from the closed position as shown in FIG. 1 to the open position as shown in FIG. 2 the handle 96 is rotated in a clockwise direction, causing the operating surface 97 of the handle 96 to apply a side-ways buckling force to the operating spring 52. This applies a force B (FIG. 1) to the hole 50. When the force B is greater than the clockwise torque about the pivot point 14 produced by the compressive force of the spring 52, the moving contact assembly 32 and latch lever 16 will rapidly rotate in a counterclockwise direction about the point 14. The moving contact assembly rotates with a snap action because it is moving toward toggle and the torque produced by the spring 52 is diminishing towards zero. Since the buckling force upon the spring is diminishing at a lower rate, the mechanism will snap to the open position, shown in FIG. 2. Thus the operating spring 52 operates as one lever of a toggle linkage as well as providing energy for the snap action.

Note that the moving contact assembly 32 pivots as a unit with the latch lever 16 since the latch tab 66 is engaged by the latch surface 28 of the latch lever 16 and the leg 64 of the armature 40 bears against the cross member 20 of the latch 16. The moving contact assembly 32 and latch lever 16 thus constitute a pivot assembly.

The action of the spring 52 against the interior surfaces of the handle cavity 110 and the action of a positioning surface 103 against the magnet plate 42 cause the handle 96 to be positioned a shown in FIG. 2.

To actuate the circuit breaker from the open circuit position to the closed circuit position the handle 96 is rotated about the trunnions 102 in a counterclockwise direction as seen in FIG. 2. The straight surface 108 of the handle operating lever 104 pushes against the operating ear 30 of the latch lever 16. The pivot assembly consisting of the latch lever 16 and moving contact assembly 32 rotates as a unit in a clockwise direction about the point 14. When the hole 50 is pushed overcenter of toggle, the compressive force of the operating spring 52 causes the pivot assembly to quickly move with a snap action to the position shown in FIG. 1, thereby providing a quick make action to the contacts 84 and 120.

Figure 3:
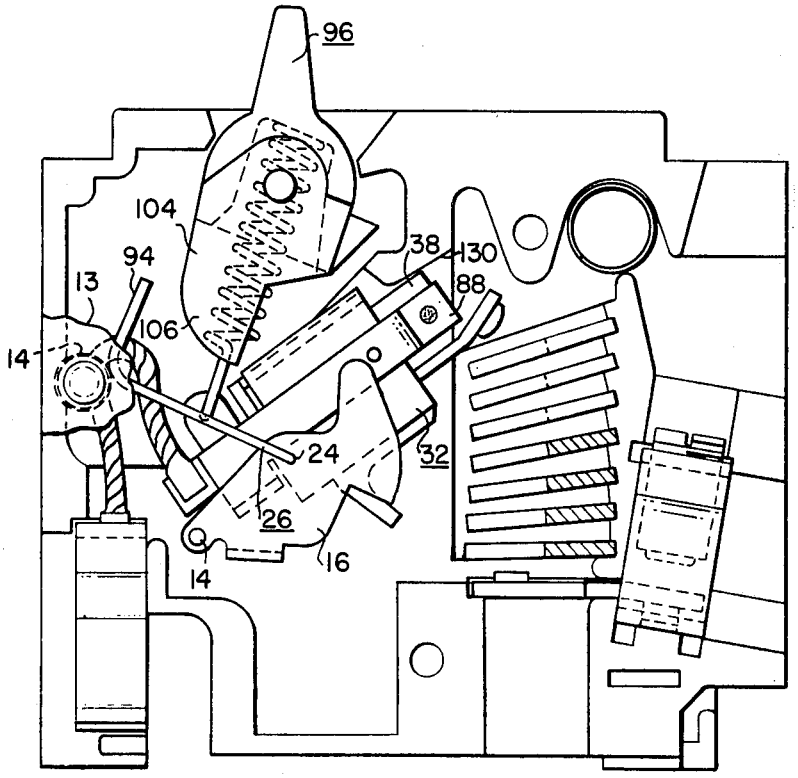
FIG. 3 is similar to FIG. 1 with the circuit breaker, contacts shown in the tripped position.

Under moderate overcurrent conditions, current flow through the contact arm 80, connecting arm 78, and bimetal element 38 causes heat to be produced. This heat produces a deflection in the bimetal element 38, causing the bimetal element 38 to apply a force E (FIG. 5) to the tab member 62 of the armature 40. The force E produces a counterclockwise torque upon the armature 40 about the pivot point at the edge of the base portion 44 of the magnet structure 36. As the bimetal element 38 continues to deflect, the torque produced upon the armature 40 will overcome the clockwise biasing torque produced by the force D of the spring 68. The armature 40 will rotate in a counterclockwise direction about the edge of the base portion 44 of the magnet structure 36, thereby removing the latch tab 66 from engagement with the latch surface 28 of the latch lever 16. The compressive force of the operating spring 52 upon the moving contact assembly 32 at the point 50 causes the moving contact assembly 32 to rapidly rotate, relative to the latch lever 16, in a counterclockwise direction about the point 24 as seen in FIG. 2. The moving contact 84 is thereby separated from the fixed contact 120 with a quick break action. The positions of the various components of the circuit breaker when in a trip condition are shown in FIG. 3.

The contact arm 80 performs a dual function. It supports the moving contact 84 and, since it is made of resistance material, it provides additional heat to produce additional bimetal deflection. The bimetal can be made from a lower resistance material, thus helping to prevent overheating on short circuit tests. In addition the thermal trip time can be increased, allowing the breaker to carry motor starting currents without tripping. The exact composition of the contact arm 80 can be varied for different breaker ratings. Note that the bimetal element 38 is not attached to the insulating housing 12, thus reducing heat loss due to conduction to the base as is common in previous breakers.

Under sudden severe overcurrent conditions, such as as short circuit, the current through the circuit breaker causes magnetic flux to be produced within the magnetic circuit 76 of the moving contact assembly 32. This magnetic flux produces a force E (FIG. 5) causing a counterclockwise torque upon the armature 40 similar to that produced by deflection of the bimetal 38 in the thermal trip condition as previously described. The armature 40 rotates in a counterclockwise direction about the pivot point at the edge of the magnet 36, thereby releasing the latch member 66 from engagement with the latch surface 28 of the latch lever 16 and causing the circuit breaker to move from the closed position as shown in FIG. 1 to trip position shown in FIG. 3, as previously described.

The contact support structure is formed so that current from the moving contact 84 flows through the contact arm 80, thus passing through the magnetic circuit 76 for the first time. The current then travels around through the connecting arm 78 to and through the bimetal 38, thus passing through the magnetic circuit 76 a second time. This design provides a two-turn coil without requiring a separate element and additional connection points. A coil formed in this manner is rigid and self-supporting and will maintain its shape without additional support. Also, insulation is not required to isolate the coil from adjacent conductive elements. Using the contact arm and bimetal as a coil saves space since the presence of the contact arm and bimetal element is already required. By allowing the current to flow twice through the magnetic circuit 76 a lower magnetic trip current valve is obtained.

Resetting of the circuit breaker is accomplished by moving the operating handle 96 in a clockwise direction as seen in FIG. 3 to the open position (FIG. 2). This action causes the curved surface 106 of the handle operating lever 104 to bear against the leg 94 of the reset lever and pivot pin 26. Since the reset lever and pivot pin 26 is guided by a boss 13 on the insulating cover, clockwise rotation on handle 96 causes the reset lever and pivot pin 26 to be drawn upward and to the left as seen in FIG. 3, thereby moving the point 24 in a similar direction. The end of the bimetal element 38 having the spot weld 88 is constrained by the surface 130 of the insulating housing 12, and the latch lever 16 is constrained by the pivot pin 14. Thus movement of the point 24 upward and to the left as seen in FIG. 3 causes counterclockwise rotation of the latch lever 16 about the pivot pin 14 and clockwise rotation of the moving contact assembly 32 about the point 24 relative to the latch lever 16. The latch surface 28 of the latch lever 16 is thus moved upward over the surface of the armature 40 until the biasing action of the bias spring 68 causes the latch surface 28 to snap into engagement with the latch tab 66. At this point the circuit breaker is in the open position as shown in FIG. 2. The reset operation is completed by moving the circuit breaker to the closed position as previously described.

From the foregoing, it is seen that the present invention has provided a circuit breaker comprising thermal and magnetic trip means which is characterized by improved performance and lower cost.

While the present invention has been shown and described in only one form, it will be obvious to those skilled in the art that it is not so limited, but is susceptible of various changes and modifications without departing from the spirit thereof.

What is claimed is:

1. A circuit breaker, comprising:

an insulating housing;

an operating handle having open, closed, and trip positions;

a latch lever;

means pivotally attaching said latch lever to said housing;

a stationary contact;

a moving contact assembly pivotally attached to said latch lever, said moving contact assembly comprising a moving contact cooperable with said stationary contact to open and close an electric circuit;

an operating spring having one end pivotally connected to said moving contact assembly and having another end engaged by said operable handle;

a latch member attached to said moving contact assembly and releasably engaging said latch lever, release of said latch lever allowing said moving contact assembly to pivot with respect to said latch lever, said pivoting movement causing said moving contact to separate from said stationary contact and open an electric circuit; and trip means operable upon overcurrent conditions through said moving and stationary contacts to effect automatic release of said latching lever by said latching member;

actuation of said operating handle between open and closed position being operable to pivot said latch lever and said moving contact assembly and cause said moving contact to cooperate with said stationary contact to open and close an electric circuit.

2. A circuit breaker as recited in claim 1 wherein said operating spring is compression.

3. A circuit breaker as recited in claim 1 wherein said moving contact assembly and said latch lever define a pivot assembly when said latch lever is engaged by said latching member, said pivot assembly being rotatable as a unit about said pivot means.

4. A circuit breaker as recited in claim 3 wherein said operating spring functions as one leg of an operating toggle linkage, collapse of said operating toggle linkage in either direction causing said pivot assembly to pivot about said pivot means and operate said movable contact.

5. A circuit breaker as recited in claim 1 wherein said moving contact assembly comprises two ends, said moving contact being attached to one of said ends and said operating spring being attached to the other of said ends, and said moving contact assembly is pivotally attached to said latch lever at a point intermediate said ends.

6. A circuit breaker as recited in claim 1 wherein said operating handle comprises a first operating member and movement of said operating handle from closed to open position causes said first operating member to exert a buckling force against said operating spring, said buckling force snapping said operating toggle linkage from one side of toggle to the other side of toggle.

7. A circuit breaker as recited in claim 6 wherein said operating handle includes a second operating member and movement of said operating handle from open to closed position causes said second operating member to exert a buckling force against said pivot assembly and force and operating toggle linkage from one side of toggle to the other side of toggle.

8. A circuit breaker, comprising:

an insulating housing;

separable contacts comprising a stationary contact and a moving contact;

an operating handle to open and close said contacts;

releasable means operable upon actuation to automatically open said contacts;

thermal trip means operable upon overcurrent conditions through said contacts to actuate said releasable means; and a contact arm supporting said moving contact, said contact arm comprising resistance material operable upon overcurrent conditions through said contacts to heat said thermal trip means;

said thermal trip means comprising a bimetal element generally parallel to and separate from said contact arm;

heat produced by said resistance material upon overcurrent conditions through said contacts causing said bimetal element to deflect and actuate said releasable means.

9. A circuit breaker, comprising:

an insulating housing;

separable contacts disposed in said housing and comprising a stationary contact and a moving contact;

an operating handle to open and close said contacts;

releasable means operable upon actuation to automatically open said contacts;

magnetic trip means operable upon overcurrent conditions through said contacts to actuate said releasable means, said magnetic trip means including a magnetic circuit; and a contact support structure disposed about said magnetic trip means so as to cause current flowing through said contacts to pass twice through said magnetic circuit.

10. A circuit breaker as recited in claim 9 wherein said magnetic trip means comprises:

a magnet structure and a magnetic member cooperating to form an open ended box structure which defines said magnetic circuit; and said contact support structure comprises:

a connecting arm attached to said box structure and having first and second ends offset from each other and extending across opposite open ends of said box structure;

a contact support arm passing through the interior of said box structure and being connected at one end to said first connecting arm end, the other end of said contact support arm having said moving contact attached thereto; and an electrical conductor extending through the interior of said box structure, said conductor being connected at one end to said second connecting arm end and connected at the other end to a terminal of an electric circuit being protected.

11. A circuit breaker as recited in claim 10 wherein said electrical conductor comprises a bimetal element.

12. A circuit breaker as recited in claim 10 wherein said releasable means comprises a latch member attached to said magnetic member and said magnetic member is pivotally attached to said magnet structure, an overcurrent condition through said contacts causing said magnetic member to be attracted toward said magnet structure and causing said latch member to release and allow said contacts to automatically open.

* * * * *